US007328643B2

(12) United States Patent
Goetsch et al.

(10) Patent No.: US 7,328,643 B2
(45) Date of Patent: Feb. 12, 2008

(54) PROCESS FOR ACCESSING MUNITIONS USING FLUID JET TECHNOLOGY

(75) Inventors: Duane A. Goetsch, Andover, MN (US); Steve J. Schmit, Ramsey, MN (US); Ryan M. Smith, Minnetonka, MN (US); Kym B. Arcuri, Tulsa, OK (US)

(73) Assignee: Gradient Technology, Elk River, MN (US)

( * ) Notice: Subject to any disclaimer, the term of this patent is extended or adjusted under 35 U.S.C. 154(b) by 0 days.

(21) Appl. No.: 10/852,471

(22) Filed: May 24, 2004

(65) Prior Publication Data

US 2008/0006142 A1 Jan. 10, 2008

Related U.S. Application Data

(60) Provisional application No. 60/472,958, filed on May 23, 2003.

(51) Int. Cl.
*F42B 33/04* (2006.01)
*F42B 33/06* (2006.01)

(52) U.S. Cl. ..... 86/50; 89/1.13

(58) Field of Classification Search ..... 86/50; 89/1.13

See application file for complete search history.

(56) References Cited

U.S. PATENT DOCUMENTS 1,492,922 A * 5/1924 Knight ..... 134/5
5,363,603 A 11/1994 Miller et al.
5,737,709 A 4/1998 Getty et al.
5,941,466 A * 8/1999 Alba et al. ..... 241/1
5,990,354 A 11/1999 Goetsch et al.
5,998,676 A 12/1999 Arcuri et al.
6,212,986 B1 * 4/2001 Decker et al. ..... 86/49
6,476,286 B1 * 11/2002 Taylor et al. ..... 149/108.2
6,525,820 B1 2/2003 Owens
6,559,413 B1 * 5/2003 Muenchausen et al. 219/121.72
6,681,675 B2 * 1/2004 Miller ..... 86/50
6,777,586 B1 8/2004 Arcuri et al.
6,886,444 B2 * 5/2005 Reid ..... 86/50
2002/0185458 A1 * 12/2002 Portman ..... 210/803
2003/0010183 A1 * 1/2003 Reid ..... 86/50

FOREIGN PATENT DOCUMENTS

DE 4221666 C1 * 1/1994

OTHER PUBLICATIONS

English abstract translation of DE 4221666 C1.*

* cited by examiner

*Primary Examiner*—Michael J. Carone
*Assistant Examiner*—Stewart T Knox
(74) *Attorney, Agent, or Firm*—Henry E. Naylor; Kean, Miller, Hawthorne, D'Armond, McCowan & Jarman, LLP

(57) ABSTRACT

A process for accessing and defusing munitions using fluid jet technology containing abrasive material and recovering the abrasive. The explosive material can also be removed from the munition casing by fluid jet technology, after the munition has been defused.

21 Claims, 2 Drawing Sheets

PROCESS FOR ACCESSING MUNITIONS USING FLUID JET TECHNOLOGY

CROSS-REFERENCE TO RELATED APPLICATIONS

This application is based on Provisional Application 60/472,958 filed May 23, 2003.

FIELD OF THE INVENTION

The present invention relates to a process for accessing and defusing munitions using fluid jet technology containing abrasive material and recovering the abrasive. The explosive material can also be removed from the munition casing by fluid jet technology, after the munition has been defused.

BACKGROUND OF THE INVENTION

Surplus munitions present a problem to the US military. Current budget constraints force the US military to prioritize its spending while effectively defending the interests of the United States. Defense budgets are further tightened because aging and surplus munitions must be guarded and stored. The US military regularly destroys a significant amount of its surplus munitions each year in order to meet its fiscal challenge. It also destroys a significant amount of munitions each year due to deterioration or obsolescence.

In the past, munitions stocks have been disposed of by open burn/open detonation (OBOD) methods—the most inexpensive and technologically simple disposal methods available. Although such methods can effectively destroy munitions, they fail to meet the challenge of minimizing waste by-products in a cost effective manner. Furthermore, such methods of disposal are undesirable from an environmental point of view because they contribute to the pollution of the environment. For example, OBOD technology produces relatively high levels of $NO_x$, acidic gases, particulates, and metal waste. Incomplete combustion products can also leach into the soil and contaminate ground water from the burning pits used for open burn methods. The surrounding soil and ground water must often be remediated after OBOD to meet environmental guidelines. Conventional incineration methods can also be used to destroy munitions, but they require a relatively large amount of fuel. They also produce a significant amount of gaseous effluent that must be treated to remove undesirable components before it can be released into the atmosphere. Thus, OBOD and incineration methods for disposing of munitions become impractical owing to increasingly stringent federal and state environmental protection regulations. Further, today's even stricter environmental regulations require that new munitions and weapon system designs incorporate demilitarization processing techniques. Increasingly stringent EPA regulations will not allow the use of OBOD or excessive incineration techniques, so new technologies must be developed to meet the new guidelines.

U.S. Pat. Nos. 5,363,603 and 5,737,709 teach the use of a fluid jet technology for cutting explosive shells and removing the explosive material. Various fluids can be used, including water and solvents in which the explosive material is soluble. The fluid jet can also carry an abrasive component to enhance the rate of cutting. These patents do not suggest the simultaneous removal of the fuse and explosive material of two or more explosive munitions and the recovery of abrasive material used in the fluid jet.

Further, conventional explosive removal processes require that the munition, or shell, first be defused. Current fuse removal techniques are either too costly or unsafe. For example, personnel must often remove the fuse by hand at great personal risk. A remote-controlled robot is sometimes used to defuse munitions, but are costly given the percentage of munitions that explode during defuzing.

While some of the above methods have met with varying degrees of success, there still remains a need in the art for improved methods and apparatus for demilitarizing explosive shells in an environmentally, efficient and safe manner.

SUMMARY OF THE INVENTION

In accordance with the present invention there is provided a process for removing the fuse and explosive material from one or more munitions simultaneously in an apparatus comprised of a fuse cut-out stage, an explosive washout stage, and a rinse stage, which munitions contain an explosive material; which process comprises:

a) providing one or more fuse containing munitions;

b) simultaneously removing the fuse from each of said one or more munitions by use of jets of high pressure fluid containing an abrasive material directed along a predetermined path around the perimeter of each fuse an effective number of times and at an effective pressure to cause cutting of said munition around each fuse;

c) removing each fuse from each munition, thereby exposing the explosive material therein and resulting in a mixture of fluid from the fluid jet, the one or more fuses, and abrasive material;

d) removing the one or more fuses from the mixture;

e) passing the fluid containing the abrasive material to a separation stage wherein the abrasive material is separated and collected from the fluid;

f) collecting the fluid for disposal, storage, or recycle;

g) removing the explosive material from said one or more defused munitions by use of a jet of high-pressure fluid, thereby resulting in demilitarized munition casings and a liquid containing the explosive material; and h) passing the liquid containing the explosive material to a separation stage wherein said explosive is separated from said liquid.

In a preferred embodiment, the jet of fluid makes multiple complete trips along said closed path while freeing said fuse from said casing.

In another preferred embodiment of the present invention, the jet of fluid makes only a single complete trip along said path before cutting through and freeing said fuse from said casing.

Also in accordance with the present invention, there is provided a process for removing the fuse and the explosive from a munition comprised of an explosive-filled metal casing having a tapered nose end and a substantially flat base end, and having a fuse at least one of said ends, which method comprises:

a) directing a jet of fluid containing an abrasive material along a predefined closed path around the perimeter of said fuse an effective number of time to cut through said casing, which fluid being at a sufficient pressure to cause said fluid to cut at least partially through said casing each time said jet of high pressure fluid makes a complete trip along said path, thereby cutting out said fuse from said casing; and b) directing a jet of fluid onto said explosive material at a pressure sufficient to cause the jet of fluid to cut through and comminute said explosive material to be removed from said casing; and c) collecting the resulting mixture of comminuted explosive material and fluid.

In another preferred embodiment of the present invention, the fluid directed onto the explosive material is a solvent with respect to at least one of the components of the explosive material.

DETAILED DESCRIPTION OF THE INVENTION

Figure 1:
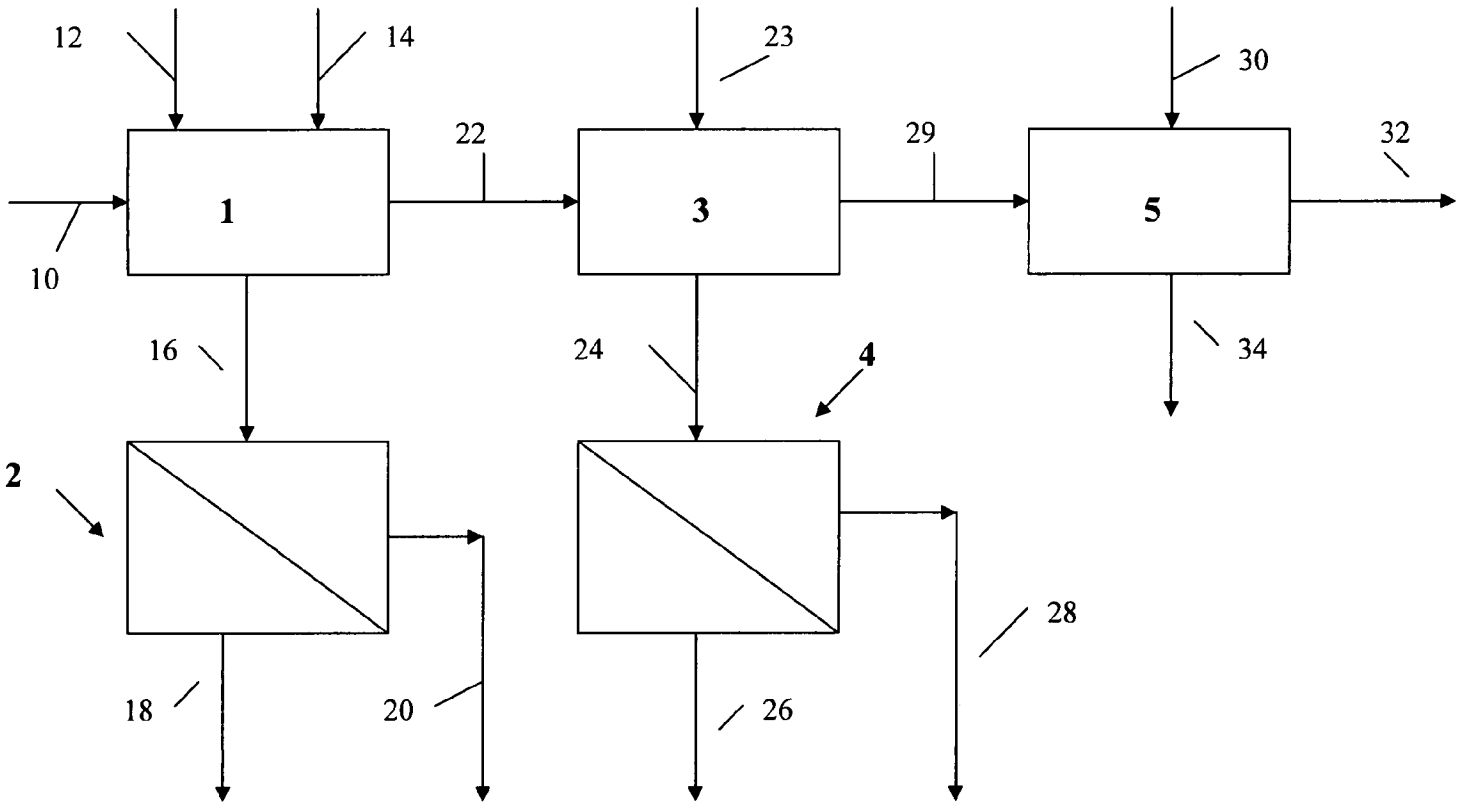
FIG. 1 hereof shows one preferred embodiment of the present invention for practicing the present invention.

Any munition or pyrotechnic device, particularly military shells including both projectiles and bombs, can be demilitarized by practice of the present invention. It is preferred to demilitarize those munitions that are relatively easily handled by a human operator of the fluid jet apparatus of the present invention. The preferred size of the munition, for purposes of this invention, is from about 3 inches to about 10 inches in diameter, although smaller and larger diameter munitions can also be demilitarized by the practice of the present invention. Such munitions are typically comprised of a cylindrical metal outer casing having a tapered forward, or nose, section and a flat rear, or base section. Although the base section typically contains the fuse, the nose section, or both the base section and the nose section, may contain a fuse. The interior of the munition contains the explosive material.

The present invention is not limited to any particular explosive material. Non-limiting examples of explosive materials that can be removed from the explosive munitions using the present invention include: ammonium perchlorate (AP); 2,4,6 trinitro-1,3-benzenediamine (DATB), ammonium picrate (Explosive D); cyclotetramethylene tetranitramine (HMX); nitrocellulose (NC); nitroguanidine (NQ); 2,2-bis[(nirtoxy)methyl]-1,3-propanediol dinitrate (PETN); hexahydro-1,3,5-trinitro-1,3,5-triazine (RDX); 2,4,5-trinitrophenol (TNP); hexahydro-1,3,5-benzenetriamine (TATB); N-methyl N-2.4.6-tetranitrobenzeneamine (Tetryl); 2-methyl-1,3,5-trinitrobenzene (TNT); Amatol (Ammonium Nitrate/TNT); Baratol ($Ba(NO_3)_2$/TNT; black powder ($KNO_3$/S/C); Comp A (RDX/wax); Comp B (RDX/TNT); Comp C(RDX/plasticizer); Cyclotol (RDX/TNT); plastic bonded explosives (PBX); LOVA propellant; NACO propellant; any combination of the above materials; rocket propellant; and Octol (HMX/TNT). Most preferred are Explosive D, HMX, RDX, TNT, and mixtures thereof.

The munition is typically coated on its interior surface with an organic liner material. Non-limiting examples of organic liner materials used for military shells include asphaltic liners, paints, and any other suitable liner material that provides a chemically stable coating that is capable of preventing the explosive components from coming into contact with the metal casing. In most cases, a sealer material is used to fill a gap left after the shell is filled with the explosive material. The presence of liner and sealer materials makes it difficult to obtain relatively pure yields of explosive components from munitions. The sealer material will usually be comprised of such things as waxes, synthetic or natural resins, or other suitable polymeric material and will typically be found at the filling end of the shell. For example, a shell, or munition casing, is filled with molten explosive material that upon solidification will undergo a relatively small amount of shrinkage that will leave an unacceptable void or space. This space will be filled with a suitable sealer material that will undergo little, if any, shrinkage upon solidification. After the space is filled with sealer material, the munition is closed by attaching a suitable end piece.

Referring now to FIG. 1 hereof, the explosive munitions to be defused and demilitarized by the practice of the present invention are moved to fuse cut-out stage 1 via line 10. Fluid is introduced into cut-out stage 1 via line 12 and abrasive via line 14. The fluid and abrasive are combined in a fluid jet system in cut-out stage 1. It is preferred that the fuse cut-out stage 1 be capable of simultaneously processing two or more munitions, preferably three or more munitions, and more preferably four munitions. However weight and size limitations for the equipment may limit the number of casing to be processed to only one. The cut-out stage is provided with a cutting jet for each munition. The munitions are positioned so that the surface of each munition containing a fuse opposes a fluid jet nozzle that is positioned to direct a jet of high-pressure fluid in a predetermined path around the perimeter of the fuse. It is preferred that the path be a closed path. That is, the jet cuts along an axis of symmetry such as a circular cut along the base plate or a circumferential cut along a specific axial position. For example, the path will typically be a closed circle since the fuse will typically have a circular shape. The munitions can be made to rotate so that the fluid jet nozzles are stationary and the jet of fluid is directed along a predetermined path around the outside perimeter of the fuse as the munition is rotated. The munition should be rotated at <25 rpm in order to prevent arming of the fuse. Alternatively, the nozzles can be made to rotate to track a predetermined path around the perimeter of the fuse, while the munition remains stationary. It is within the scope of the present invention that both the munitions and the fluid jet rotate, although it is most preferred that only the munition be rotated. It is preferred that the munitions be rotated and that the fluid jet apparatus, such as a wand containing the nozzle, is substantially rotationally static and moves only longitudinally to the body of the munition.

The fluid jet will be of sufficient pressure to cause cutting of the shell, or munition casing. The cutting of the munition casings to remove the fuses may be done by any suitable procedure. For example, the cutting can be conduced gradually along the cutting path around the perimeter of the fuse by making multiple passes along the cutting path until the fluid jet cuts through the casing and the fuse is isolated and washed free of the casing by the cutting fluid. During this procedure, the depth of the cut during each pass along the cutting path increases gradually so that piercing, or cutting entirely through, the casing is a gradual process. This procedure is preferred when it is only desired to remove the fuse and not to immediately remove the material within the munition. Alternatively, the pressure of the fluid jet can be substantially increased so that the base of the munition is pierced and the high pressure fluid jet is directed along the cutting path only once while cutting entirely though the base of the casing during its travel around the perimeter of the fuse. This procedure has the advantage of removing the fuse from the munition while simultaneously removing at least a portion of the explosive material. The operating pressure of the fluid jets will be from about 20,000 to about 150,000 psig, preferably from about 40,000 to about 150,000 psig with a jet diameter from about 0.005 to about 0.10 inch.

The fluid jet can also cut along the radial perimeter of the munition at any distance along the munition. This type of cut is preferred when it is advantageous to removed axial sections of the munition without discharging the entire contents through the base. When this type of accessing is desired either the munition or the cutting head can be rotated in a fashion similar to that discussed when cutting through the base, During the accessing, washout and rinsing of the munition casing, the munition is rotated at a relatively low rotation rate (<20 rpm). The preferred fluid pressure during accessing is 20,000 to 70,000 psig. Higher pressures may provide greater cutting efficiency with respect to fluid usage and shorter total cut times. However the lower pressures are preferred with respect to the mechanical attrition of the abrasive particles. In some cases higher pressures may be preferred but this will lead to a higher attrition rate and smaller spent abrasive particles thereby making separation and recovery more complicated.

The fluid of the fluid jet will contain an abrasive material to enhance cutting. Non-limiting examples of abrasive materials that are suitable for use in the present invention include glass, silica, alumina, silicon carbide, garnet, as well as elemental metal and metal alloy slags and grits. The preferred abrasive material is garnet. It is preferred that the abrasive either have sharp edges or that it be capable of fracturing into pieces having sharp edges to enhance cutting. Non-limiting examples include octahedron or dodecahedron shaped particles. The size of the abrasive particles may be any suitable effective size. By effective size, we mean a size that will be effective for cutting the metal munition casing (typically a metal alloy, such a steel) and which is effective for forming a substantially homogeneous mixture with the fluid carrier. Useful average particle sizes of abrasive material range from about 3000 microns to 55 microns, preferably from about 1500 microns to 105 microns, and most preferably from about 125 microns to about 250 microns. Generally, the most preferred abrasives have been found to be garnets and aluminum-based materials having an average particle size from about 125 microns mesh to about 250 microns.

The concentration of the abrasive within the fluid will range in slurry fluid jet systems from about 1 to about 50 wt. %, preferably from about 5 to 40 wt. %, and most preferably from about 5 to 20 wt. %. For entrained fluid jet systems, the amount of abrasive will generally be about 5 wt. % to 35 wt. %, preferably from about 5 wt. % to about 25 wt. % of total fluid plus abrasive, depending on the diameter of the orifice of the nozzle. Increasing the concentration of an abrasive, generally, has a tendency to increase the cutting efficacy of the fluid jet.

The preferred solvent is water or other polar materials such as acetone, alcohols, ketones, aldehydes or mixtures thereof. In order to minimize separation issues the fluid should not contain any surface-active agents. The fluid should be free of any components, which can interact with suspended solids in such a way to promote the wetting of suspended solids there by reducing their tendency to settle. Additionally the fluid should be free of any constituents, which enhance the solubility of relatively non-polar hydrocarbon compounds such as asphalt.

The accessing step is completed upon completion of the cut of the munition casing. Any suitable method can be used for detecting the completion of the accessing phase. For example, an acoustical signal from a fluid jet contacting a munition casing varies with the stand off distance from the munition casing. As the standoff distance increases, the acoustical signal will shift to longer frequencies. When employing a trapan cutting method, the standoff distance can be held relatively constant by continually lifting the jet nozzle up towards the munition casing by the same incremental length of the cut. This way, the acoustical signal from the system can be held relatively constant. Upon completion of the cut the jet enters into the munition cavity no longer contacting the metal wall. At this, point the acoustic signal will change A second method which can be employed when using the trapan cutting method involves sensing the fall of the metal plug at completion of cut-out. As the fuse drops guide rails can be employed to control the trajectory of the dropping fuse and a mechanical or optical sensor can be employed to record the passage of the fuse.

A third method based for sensing the completion of the accessing cut can be based on the chemical or physical characteristics of the slurry draining from the round. For example if water is used as the cutting fluid for accessing Yellow D rounds, an electrical conductivity probe can be employed to determine the flow of Yellow D with the cutting fluid. A capacitance probe can be employed for other accessing fluids.

In some cases the trapan cut can be completed but the annular section of the base plate will not fall away from the munition. The adhesive forces of the explosive mixture and other components within the munition cavity are sufficiently strong enough to support the annular section. This problem can be corrected by cutting at a angle relative to the base plate. By cutting at an angle of approximately 3-20 degrees, the accessing jet cuts at a cone within the interior of the munition cavity there by removing any solid material within the cavity which may hold the base fuse in place through adhesion.

If the intent is to recover the explosive for re-use, or conversion to high valued material, it is advantageous to minimize the amount of explosive material removed from the munition during cut-out.

Upon completion of the accessing cut, the munition can be moved to another position or the fluid jet characteristics can be changed from that of accessing to those required for washout or removal of explosive material from the munition. The principal changes involve reducing the fluid jet pressures and the jet characteristics to allow for a broader fluid projection.

The fluid of the fluid jet is any suitable composition that is normally a liquid. By "normally liquid" we mean that it will be in the liquid state at substantially atmospheric temperatures and pressures. For example, it can be water or an organic solvent, in which at least a portion of the explosive material being removed is at least partially soluble. In one preferred embodiment of the present invention, the fluid used to cut out the fuse(s) is water, plus an abrasive, and the fluid used to washout, or cut out, the explosive material within the munition casing is a solvent with respect to at least one component of the materials within the casing, preferably with respect to at least one of the explosive components. It is preferred that the fluid be nontoxic so as to maintain the environmental usefulness of the cutting/demilitarization process. Non-limiting examples of organic solvents suitable for use in the practice of the present invention include: alkyl alcohols, alkyl ketones, alkyl nitrites, nitroalkanes, and halo-alkanes. More particularly, the alkyl group of the organic solvent may be branched, cyclic, or straight chain of from about 3 to 20 carbons. Examples of such alkyl groups include octyl, dodecyl, propyl, pentyl, hexyl, cyclohexyl, and the like. Methanol and ethanol are the preferred alcohols, more preferred is methanol. The alcohols may also contain such alkyl groups. Non-limiting examples of ketones include acetone, cyclohexanone, propanone, and the like. Non-limiting examples of nitro compounds that can used as the carrier for the fluid jet in the practice of the present invention are acetonitrile, propylnitrile, octylnitrile, and the like. Non-limiting examples of halogenated alkanes include methylene chloride, chloroform, tetrahaloethylene and perhaloethane, and the like. Preferably, aqueous and aqueous/organic mixtures are used as the fluid which is more preferably nontoxic and cost effective, given the compatibility with the explosive material to be removed. Such more preferred fluids include propylene and ethylene glycol, fuel oil compositions such as gasoline and diesel oil, water, short chain alkyl alcohols, mineral oil, glycerine, and mixtures thereof.

While the fluid may comprise any number of aqueous, organic, or aqueous/organic components, the fluid is capable of producing a relatively low viscosity fluid jet, containing abrasive that can pass through an orifice of the nozzles used in the practice of the present invention. Typically, the orifice will be from about 0.002 inch to about 0.054 inch in diameter. Such orifices are readily commercially available and are typically fabricated from sapphires or diamonds.

Figure 2:
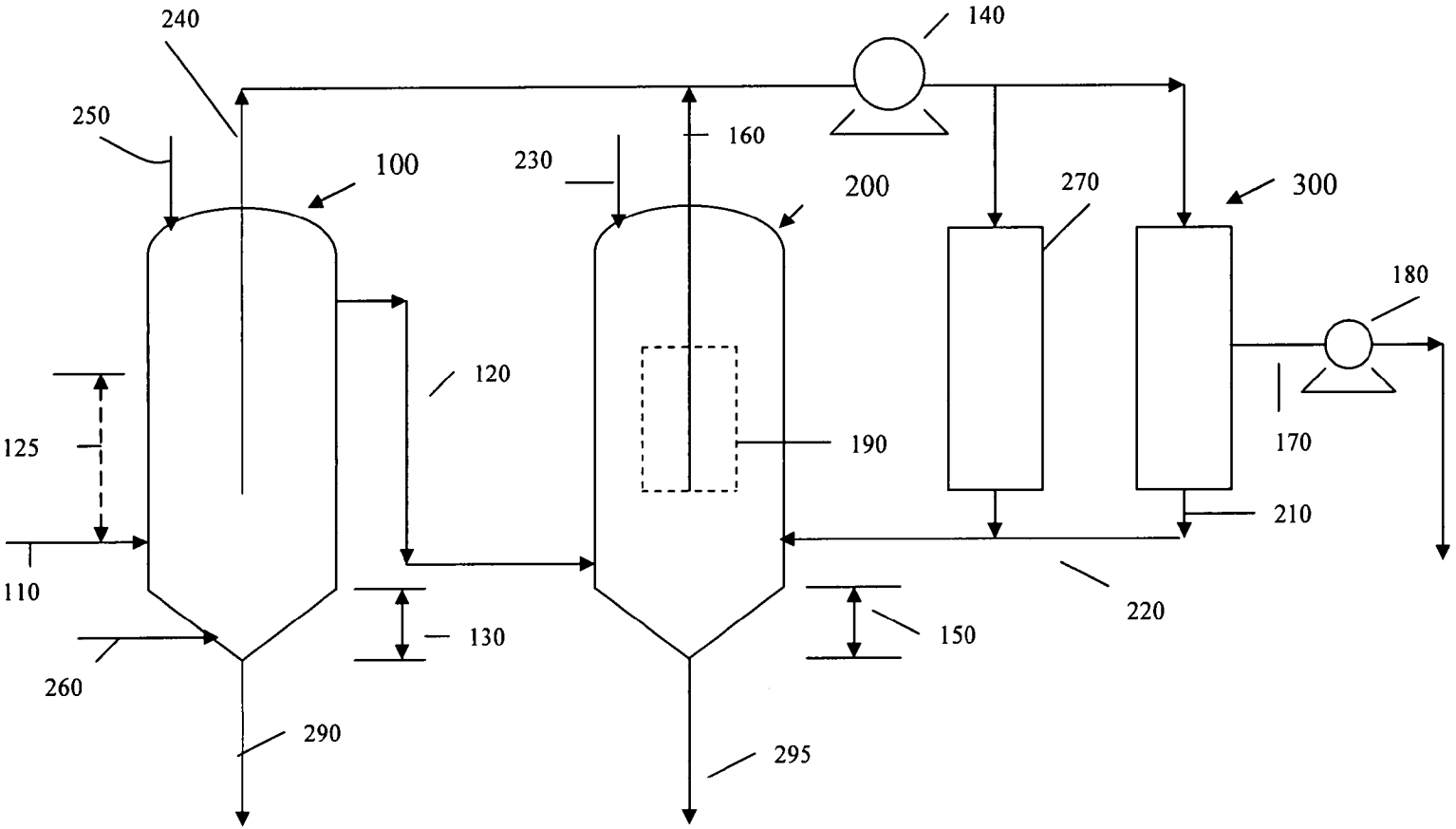
FIG. 2 hereof shows a preferred abrasive recovery system of the present invention.

Referring again to FIG. 1 hereof, abrasive material and fluid are collected and passed, via line 16, to abrasive separation unit 2 where the abrasive material is separated and recovered for recycle as shown in more detail in FIG. 2 hereof. The abrasive material and the fluid, for simplicity sake for this FIG. 1, are separately collected via lines 20 and 18 respectively, and each can be recycled to fuse cut-out stage 1. It is within the scope of this invention that instead of accessing the explosive material in the munition by cutting out the fuse, the munition is cut open at a section other than one containing a fuse. For example, the munition can be cut at some point between its two ends to expose the explosive contents for removal.

After the munitions are defused, they are subjected to an explosive washout stage 3, which is preferably the same apparatus as cut-out stage 1. Line 22 is shown in the case where the defused shells need to be physically moved to a different station than the cut-out station. In washout stage 3, the munitions are subjected to a fluid jet that is used to cut into the interior of the munition to remove the explosive material. Fluid enters washout stage 3 via line 23. The exposed explosive material is subjected to a high-pressure jet of washout fluid that will preferably be delivered by a translationally mobile nozzle mounted at the end of a hollow lance or wand. Although the wand or lance can be rotated within the interior of the casing. It will be understood that the munitions can be rotated instead and the wand held rotationally stationary. Also, both the wand and the munitions can be rotated.

Although the fluid jet used to wash-out the explosive material can contain an abrasive, it is preferred that the fluid used in this step be used without an abrasive. It is also preferred that the fluid be a fluid in which at least one component of the explosive components is at least partially soluble. The resulting waste stream from this explosive wash-out step 3 will contain both explosive material and wash-out fluid. This mixture is sent via line 24 to separation unit 4 where the explosive-material is recovered from the wash-out fluid, also by conventional solid-liquid separation techniques. The washout fluid can be collected via line 26 for recycle and the explosive material collected via line 28 for reuse or further processing. The wash-out fluid can be water or any of the above mentioned solvents.

It is preferred that the resulting demilitarized munition casings be subjected to a rinse stage 5 to achieve a so-called "5× cleanliness's. 5× cleanliness is typically required by Army Material Command Regulation 385-5 for explosives and Army Command Regulation 385-61 for chemical weapons. In some cases, a less stringent cleanliness requirement (3× cleanliness under the same regulations as stated above) may be adequate. If this rinse stage is not in the same apparatus as the washout stage the shells are moved via line 29 from the washout stage to the rinse stage. A rinse fluid, preferably water, is introduced to rinse stage 5 via line 30 where it is used to rinse out any remaining explosive material or organic liner material contaminants that are left in the shell. The cleaned shells are collected via line 32 and can be sold as scrap metal. The rinse fluid is collected via line 34, and if needed can go through an additional separation stage to remove any contaminants before it can be recycled.

As previously mentioned, an abrasive is used with the fluid jet to enhance cutting. The abrasive is typically used in only a single pass in conventional metal-cutting processes and is not recovered for reuse. The abrasive, which is preferably a garnet material, may attrit during the acceleration process in the focusing tube of the cutting nozzle head when it strikes the surface of the munition being cut. The abrasive fines produced by attrition are not preferred for cutting out the fuse because they will slow down the cutting time. Such fines can be better used for cutting relatively small parts and parts that require a fine finish on the cut surfaces. Also, the abrasive is wet after cutting would need to be dried before reuse. The preferred abrasive recovery system of the present invention accomplishes the separation of the coarser abrasive particles that will still produce satisfactory results during cutting. This preferred embodiment for recovering the abrasive could best be understood by reference to FIG. 2 hereof. FIG. 2 presents a representative flow plan for a preferred abrasives management system. A slurry containing abrasive material, swarf, and explosive material, such as Yellow D in both the dissolved and possibly solid state flows into the primary settling vessel 100 along conduit 110. The size and operation of vessel 100 can be in accordance to standard practices employed for solid/liquid separators. The conduit 110 can be a pipe in which the flow occurs by the gravity head difference from a collection well (not shown) located below the cut-out stage of FIG. 1 hereof and vessel 100. During solid/liquid separation operations, the overflow from the primary settling vessel 100 is discharged via conduit 120 and passes into secondary settling vessel 200.

A preferred embodiment incorporates a diameter such that the rise velocity of the liquid through the settling zone 125 is about 0.5 cm/sec or less. Lower liquid rise velocities are preferred in order to minimize the amount of solids carried out of the primary vessel 100 into conduit 120. The preferred liquid rise velocity for liquid/solid separations is determined using methods well established in the art. Typically the abrasive and other solid materials exiting the munition cavity have higher densities than water. Consequently the length of settling zone 125 does not have to exceed 6 feet in length and the diameter of vessel 100 is set in accordance with the practices for gravity settlers in order to accommodate the flow of the spent abrasive slurry. A preferred embodiment incorporates a distance on the order of about 3 feet. Longer distances, or lower liquid rise velocities are preferred when there are a significant amount of solids (greater than 5 wt. % based on liquid mass) which have relatively low densities (>1.3 gm/cm$^3$).

The abrasive material and explosive material, as well as other solids with a density greater than the liquid, accumulate in the lower section of vessel 100 that can have a cone or other appropriate geometry conducive to the removal of solids at a latter time in the process. A preferred embodiment incorporates a cone designed at 130. The volume needed for the settled solids depends upon several factors such as the total slurry throughput and the amount of solids to be separated.

Vessel 200 functions both as a settling vessel and as a liquid volume for the filtration pump 140. Vessel 200 can have a relatively low settling volume 150 since under normal operations only solids which enter the vessel 200 are exceeding small or lower density solid constituents which did not settle in the primary vessel 100. In a preferred embodiment, a small settling volume (on the order of 20-30% of the primary volume) should be utilized in order to prevent an excess of solids due to a flow upset in the primary vessel 100 to enter into the pump feed line via 160.

The exit flow from vessel 200 passes through conduit 160 and through filtration pump 140. Conduit 160 consists of an inlet port located at the upper section of the vessel well above the solids discharge port 295 and at the upper section of the settling zone 150. The inlet to conduit 160 should be located well below the normal liquid level in order to provide a continuous liquid flow to the pump 140 under conditions where there may be fluctuations in the vessel 100. In a preferred embodiment, the liquid level in secondary vessel 200 will be on the order of 60-70% of the vessel volume. The diameter of the secondary vessel 200 can be based on the setting a liquid rise velocity small amount to collect a significant amount of the solids which can enter into the vessel due to a flow upset in the primary settler.

Since the particle sizes within vessel 200 are exceeding small and are at relatively low volume fractions (<5 vol. % of the total slurry), additional separation through gravity settling will not be effective. The slurry contained within the vessel 200 is pumped through a filtration system 300 at a sufficiently high linear velocity to prevent the accumulation of a filter cake that reduces the liquid flow through the filter media. The filtration system 300 is preferably a conventional cross-flow filtration system available through commercial suppliers (i.e. LCI Corporation Houston, Tex.). The filter area should preferably be set to allow a flux of about 0.25 to 0.5 gallons/min/ft$^3$ when the solids levels are relatively low (<1-2 vol %). Larger filter areas leading to fluxes <0.25 gallons/min/ft$^2$ may be preferred if higher solids levels are present in the feed to the secondary settler. The preferred velocity through the filtration system should be set at a minimum of 15 ft/sec. Higher velocities will allow the use of lower filter area however there is a practical limit to the size of the pump and the volumetric throughput through the filter loop. Generally velocities in excess of 40 ft/sec lead to excessive pump costs and pressure drops. Lower velocities will diminish filter efficiency and are employed only when there is a low solids loading within the overflow line 160 from vessel 200.

Within the filtration system, the solids free liquid or filtrate exits the filter system 170 and passes to storage or further treatment systems (not shown). A pump 180 may be employed to provide sufficient pressure to move the liquid to the downstream processing or storage.

The effluent unfiltered slurry 210 from the filtration system 300 is sent back to vessel 200 via conduit 220. The location of the return conduit 220 should be located above the entry port for conduit 120. This will allow settling of any large particles contained in conduit 120 within the lower section of the secondary settler.

A magnetic filter or trap 190 may can be utilized to assist in collecting the small particles consisting of swarf and abrasive materials that have sufficient magnetic properties. The use of the magnetic traps helps reduce the size of the cross flow filtration area. The magnetic filter can also be placed within the flow lines after the pump 140 and prior to the return to vessel 200. These alternate locations of the magnetic filter include all lines from the discharge of pump 140 through the filter housing and the return line to volume 200.

In some cases the high solids removal efficiency of a cross flow filter system may not be necessary. This is true in cases where the explosive may not exist as an extremely fine particle or high filter efficiency is not necessary involve sites where water treatment is not very costly and/or quantities generated in water jet operations are relative small. In these cases a conventional filter systems such as in line cartridge filters can be used.

Solids Washing

The abrasive recovery operations commence after sufficient solids have collected within the primary vessel 100. At this point in the operation all flow to vessel 100 is stopped. The liquid contained in the secondary vessel 200 is sent through the filtration system 300 in order to reduce the total liquid inventory in this vessel. Conduit 230 containing a compressed gas can be employed in order to assist the passage of liquid from the secondary settling vessel 200 through conduit 160 and into the cross flow filtration pump 140. The liquid contained within the primary settling vessel 100 can be removed and passed through the filter when there is sufficient volume within the secondary vessel to receive this material.

The liquid within primary vessel 100 is withdrawn via conduit 240 and sent to the cross flow filtration pump 140. The inlet to conduit 240 should be located as low as possible within vessel 100 to remove as much liquid as possible. However, there is a practical limit to the depth of the inlet since it must be located at a sufficient height above the settled solids to prevent the passage of a significant amount of solids through conduit 240 to pump 140. The preferred minimum distance between the inlet of conduit 240 and the settled solids is 6 inches. The use of pressure can be employed to assist in transferring the slurry from the primary settling vessel through conduit 240. Conduit 250 contains a compressed gas (i.e. nitrogen or air) which is introduced into vessel 100 in order to elevate the pressure for lifting the liquid via conduit 240.

Upon removal of significant amounts of liquid from vessels 100 and 200 via conduits 240 and 160, it is necessary to remove the explosive materials contained within the settled solids. Clean liquid is introduced into the primary settling vessel 100 through conduit 260. Clean liquid is defined as material containing explosive materials at levels below that required for discharge without any environmental liabilities associated with the explosive material. The amount of clean liquid introduced into primary vessel 100 must be sufficient to dissolve any solid explosive material and displace the residual liquid containing dissolved explosive material. In the case involving the Yellow D explosive water is employed as the clean liquid. In the case of Comp B or Tritonal, acetone or methanol is employed as the clean liquid. Other explosives may require other types of clean fluids. The preferred clean liquid must possess a high solubility towards the explosive material and be easily displaced or removed from the solids matrix by displacement with water.

The clean liquid introduced into primary vessel 100 dissolves and displaces the residual explosive material and is sent to the filtration system through conduit 240 and pump 140. It will be necessary to add a sufficient amount of clean liquid to reduce the explosive levels in the settled solids to values typically less than 10 wppm. In most cases it will be necessary to add 2-5 batches of clean liquid into the primary settler. A batch is defined as the volume of clean liquid necessary to fill the primary settler vessel.

The identical procedure should be performed in the secondary settler vessel if there is a significant amount of settled solids. A significant amount of solids is defined as a volume preventing the continued usage of the settling vessel due to the accumulation of solids within the vessel.

An absorption bed 270 can be employed to remove trace quantities of explosive material from the liquid. For example in the case of Yellow D, the amount of water employed as the clean fluid can be reduced by passing the liquid through a carbon bed. Residual levels of TNT or RDX dissolved in acetone will require other types of adsorbents such as the DOWEX Ion Exchange resins provided by Dow Chemical.

The effluent liquid containing the residual explosive material is sent via conduit 200 to further processing. In some cases a pump 180 is needed to transfer the solids free liquid. In the case of Yellow D, the solids free liquid from conduit 170 containing the explosive material is sent to a evaporator in order to recover clean water and to concentrate the explosive material to higher levels for further processing. In the case of RDX or TNT, the clean solvent containing acetone which can contain varying levels of water must be sent to a crystallization vessel to recover the explosive material and then to a acetone/water separation step such as a distillation column.

When employing a clean fluid which is not water such as acetone, the final step in the solid washing operations involves the introduction of clean water into the lower section of the primary settling vessel. This is performed through conduit 260. The amount of water needed corresponds to the volume necessary to remove the levels of the non-aqueous fluid to those allowing discharge as a non-hazardous material.

In cases where the amount of dissolved explosives in the effluent liquid from vessel 100 is relatively small, an absorption system can be used to remove the explosive and allow reuse of the solvent. In other cases it may be advantageous to wash the solids down to an exceeding low level of the explosive material than subject the wet solid matrix to a thermal treatment. This procedure can be employed when the residual levels of the explosive or energetic material is relatively low and special air emission equipment is not necessary.

Solids Recovery

The solids recovery phase begins after sufficient clean liquid has been introduced into the primary settling vessel to reduce the levels of explosive materials to values which permit discharge as non-hazardous waste. If the secondary settler contains significant amounts of solids requiring discharge as non-hazardous material, a similar washing operation is performed.

The solids are discharged through the discharge ports 290 for the primary settler and 295 for the secondary settler. The solids must contain sufficiently low levels of explosives and non-aqueous liquids (if employed) so as to allow management of the recovered materials as a non-hazardous waste. The solids are discharged in the form of a dense phase slurry containing water in the range of 20-60 wt %. The minimum water level corresponds to that of the settled solid voidage but in most cases higher water levels will exist since this will allow easier discharge through the exit ports.

The recovered explosive material can be passed to an additional stage (not shown) wherein the explosive material is converted to useful and commercially valuable chemicals. For example, if the explosive component is tritonal (TNT plus aluminum powder) or Composition B (RDX plus TNT) the fluid of the fluid jet can preferably be a solvent in which only the TNT is soluble and not the aluminum powder or RDX. The aluminum powder is recovered by conventional solid-liquid separation techniques and the TNT or RDX is covered by evaporating the solvent and recrystallizing the TNT or RDX. Such process are taught in co-pending US patent application Ser. Nos. 09/569,661 and 09/569,662, entitled respectively Reclaiming TNT and Aluminum From Tritonal and Tritonal-Containing Munitions, and Reclaiming RDX and Aluminum from Composition B and Composition B-Containing Munitions, both of which are incorporated herein by reference. If the explosive is ammonium picrate it can be converted to picric acid in a two phase system as disclosed in U.S. Pat. No. 5,998,676, which is also incorporated herein by reference.

The invention claimed is:

1. A process for removing the fuse and explosive material from one or more munitions simultaneously in an apparatus comprised of a fuse cut-out stage, an explosive washout stage, and a rinse stage, which munitions contain an explosive material; which process comprises:

a) providing one or more fuse containing munitions characterized as having a cylindrical metal outer casing encasing an explosive material and having a tappered first end and flat second end and a fuse that can be located at either said first end or said second end;

b) vertically positioning said one or more munitions so that the end containing said fuse will be in the downward position;

c) positioning a water jet nozzle pointing upward and opposing said end of said munition containing the fuse;

(d) simultaneously cutting the fuse from each of said one or more munitions by directing a jet of high pressure water containing an abrasive material along a predetermined path around the perimeter of each fuse an effective number of times and at an effective pressure to cause cutting of said munition around each fuse wherein the jet of high pressure water is in a fixed position and it directed along its path around the perimeter of each fuse by rotating the one or more munitions at an effective rotational speed until each fuse is freed from it respective munition thereby exposing the explosive material contained within said munition and resulting in a mixture of water and abrasive material;

e) passing the mixture of water containing the abrasive material to a separation stage wherein the abrasive material is separated and collected from the water;

f) collecting the water for disposal, storage, or recycle;

g) removing the explosive material from said one or more defused munitions by use of a jet of high-pressure fluid, thereby resulting in demilitarized munition casings and a liquid slurry containing the explosive material along with any binder and sealant material from the interior of the munition; and h) passing the liquid containing the explosive material to a separation stage wherein said explosive is separated from said liquid slurry.

2. The process of claim 1 wherein two or more munitions are simultaneously processed.

3. The process of claim 1 wherein the abrasive is selected from the group consisting of glass, silica, alumina, silicon carbide, garnet, elemental metal, metal alloy slags, and grits.

4. The process of claim 3 wherein the abrasive is a garnet.

5. The process of claim 1 wherein the fluid of the fluid jet used in step g) is a solvent selected from the group consisting of alkyl alcohols, alkyl ketones, alkyl nitriles, nitroalkanes, and halo-alkanes.

6. The process of claim 1 wherein at least a portion of the recovered abrasive material is recycled.

7. The process of claim 1 wherein the explosive material is separated from the binder material and the sealant material.

8. The process of claim 1 wherein the explosive material is Composition B.

9. The process of claim 1 wherein the explosive material that is removed from the munition is removed in a mixture of fluid from the fluid jet and abrasive material.

10. The process of claim 9 wherein the abrasive material is separated from the fluid and the explosive material.

11. A process for removing the fuse and explosive material from two or more munitions simultaneously in an apparatus comprised of a fuse cut-out stage, an explosive washout stage, and a rinse stage, which munitions contain an explosive material; which process comprises:

a) providing two or more fuse containing munitions characterized as having a cylindrical metal outer casing encasing an explosive material and having a tappered first end and flat second end and a fuse that can be located at either said first end or said second end;

b) vertically positioning each munition so that the end containing said fuse will be in the downward position;

c) position a water jet nozzle pointing upward and opposing said end of each munition containing the fuse;

(d) simultaneously cutting the fuse from each of said two or more munitions by directing a jet of high pressure water containing an abrasive material along a predetermined path around the perimeter of each fuse an effective number of times and at an effective pressure to cause cutting of said munition around each fuse wherein the jet of high pressure water is in a fixed position and it directed along its path around the perimeter of each fuse by rotating the one or more munitions at an effective rotational speed until each fuse is freed of it respective munition thereby exposing the explosive material contained with said munition and resulting in a mixture of water and abrasive material;

e) passing the mixture of fluid containing the abrasive material to a separation stage wherein the abrasive material is separated and collected from the fluid;

f) collecting the water for disposal, storage, or recycle;

g) removing the explosive material from said two or more defused munitions by use of a jet of high-pressure fluid, thereby resulting in demilitarized munition casings and a liquid slurry containing the explosive material along with any binder and sealant material from the interior of the munition; and h) passing the liquid containing the explosive material to a separation stage wherein said explosive is separated from said liquid.

12. The process of claim 11 wherein 4 munitions are simultaneously processed.

13. The process of claim 11 wherein the abrasive is selected from the group consist of glass, silica, alumina, silicon carbide, garnet, elemental metal, metal alloy slags, and grits.

14. The process of claim 13 wherein the abrasive is a garnet.

15. The process of claim 11 wherein the fluid of the fluid jet used in step g) is a solvent selected from the group consisting of alkyl alcohols, alkyl ketones, alkyl nitriles, nitroalkanes, and halo-alkanes.

16. The process of claim 11 wherein at least a portion of the recovered abrasive material is recycled.

17. The process of claim 11 wherein the explosive material that is removed from the munition also contains binder material and a sealant material.

18. The process of claim 17 wherein the explosive material is separated from the binder material and the sealant material.

19. The process of claim 11 wherein the explosive material is Composition B.

20. The process of claim 11 wherein the explosive material that is removed from the munition is removed in a mixture of fluid from the fluid jet and abrasive material.

21. The process of claim 20 wherein the abrasive material is separated from the fluid and the explosive material.

* * * * *